United States Patent [19]

Petty et al.

[11] Patent Number: 4,983,073

[45] Date of Patent: Jan. 8, 1991

[54] COLUMN STABILIZED PLATFORM WITH IMPROVED HEAVE MOTION

[75] Inventors: Terry D. Petty, Kenner; Luc G. Chabot, La Place; Carmon R. Costello, Kenner; Kun K. Song, New Orleans, all of La.

[73] Assignee: Odeco, Inc., New Orleans, La.

[21] Appl. No.: 16,317

[22] Filed: Feb. 19, 1987

[51] Int. Cl.[5] ..... E02B 17/00; B63B 35/44

[52] U.S. Cl. ..... 405/224; 114/230; 114/294; 166/354; 166/368; 405/195

[58] Field of Search ..... 405/224, 202, 211; 114/265, 264, 230, 293, 294; 166/354, 368, 359, 380, 367; 175/5, 7

[56] References Cited

U.S. PATENT DOCUMENTS

| | | | |
|---|---|---|---|
| 3,490,406 | 1/1970 | O'Reilly et al. | 405/224 X |
| 3,648,638 | 3/1972 | Blenkarn | 405/202 X |
| 3,988,898 | 11/1976 | McDonald | 405/224 |
| 4,114,393 | 9/1978 | Engle et al. | 405/211 X |
| 4,155,673 | 5/1979 | Yashima | 405/224 |
| 4,169,424 | 10/1979 | Newby et al. | 405/224 X |
| 4,470,721 | 9/1984 | Shotbolt | 405/195 |
| 4,516,882 | 5/1985 | Brewer et al. | 405/224 |
| 4,537,533 | 8/1985 | Hampton | 405/224 X |
| 4,556,340 | 12/1985 | Morton | 405/169 X |
| 4,585,373 | 4/1986 | Collipp | 405/224 |
| 4,669,916 | 6/1987 | White et al. | 405/224 |
| 4,733,991 | 3/1988 | Myers | 405/224 X |

*Primary Examiner*—Dennis L. Taylor
*Attorney, Agent, or Firm*—Michael P. Breston

[57] ABSTRACT

The semi-submersible platform comprises a submersible lower hull including a plurality of spaced-apart hull segments. A wave-transparent stabilizing superstructure extends from the lower hull. An upper hull is supported by the superstructure. A wellhead system is suspended from the platform. A catenary mooring system moors the platform to the seabed, and plurality of risers connect the individual wellheads on the platform to the wellbores in the seabed.

29 Claims, 9 Drawing Sheets

COLUMN STABILIZED PLATFORM WITH IMPROVED HEAVE MOTION

BACKGROUND OF THE INVENTION

1. Field of the Invention

The present invention relates generally to column stabilized floating structures and more particularly to a floating oil and gas drilling and/or production platform having a minimum response to the excitation imparted thereon by a seaway.

2. Description of the Prior Art

As the search for offshore oil proceeds to deeper water, the cost of finding and producing oil and gas becomes very expensive. The primary cost is that of the platform structure which supports the production equipment and/or the wellhead equipment through which the oil is produced.

For a platform to be fixed to the seabed in deep water, the support structure part would be very expensive but the wellhead system part would be relatively inexpensive. For present day relatively shallow floating production systems, the supporting structure part is relatively inexpensive, but due to motions in a seaway, the wellheads (known as "wellhead trees") must be placed on or near to the wellbores in the seabed and remote from operating personnel, which requires that the wellhead equipment be very intricate, elaborate, and consequently very expensive and relatively inefficient.

Also, when a severe storm approaches the production site, due to the excessive motions of the floating structure, it is common practice to disconnect the elaborate subsea wellhead equipment. This disconnection and the subsequent reconnection, after the severe storm passes, impose considerable down time which results in lost production and consequently a loss of revenue.

Therefore, it is desired (1) to have a free-floating, economical production platform unit with very low motion response, particularly minimum heave, so that the wellheads can be installed onboard the platform where they would be readily accessible for operation and maintenance, and (2) to eliminate the need to disconnect the wellhead equipment between the seabed and the platform when a severe storm occurs, see U.S. Pat. Nos. 4,850,744, 4,934,870, 4,936,710 and 4,913,592, assigned to the same assignee.

The problems caused for a floating platform by excessive motions including heave are well described in the patent literature, see for example, U.S. Pat. Nos. 4,112,864 and 4,167,147.

It is the primary object of the present invention to reduce the undesirable heave by (1) utilizing the positive effects of the water plane provided by the columns and (2) by reducing the hydrodynamic forces acting on the submerged lower hull, thereby allowing oil and gas production from surface type wellheads and associated equipment to be suspended from the floating platform unit, instead of being on or near the seabed.

Further objects of this invention are to provide a floating production unit which has extremely low vertical and angular motion responses to wind and waves, which is capable of withstanding severe storms without the need to disconnect the onboard wellhead equipment between the floating structure and the seabed, and which is economical to manufacture, competitively priced with, and more efficient than known types of offshore production structures.

SUMMARY OF THE INVENTION

The semi-submersible platform of the invention comprises a submersible lower hull including a plurality of hollow, tubular, spaced-apart hull segments. A stabilizing superstructure extends from the lower hull. The superstructure comprises a plurality of vertical hollow tubular stabilizing columns disposed in angularly spaced-apart relation. An upper hull is supported by the superstructure. A wellhead tree system is suspended from the platform. A catenary mooring system moors the platform to the seabed. A plurality of risers connect the individual wellheads on the platform to the wellbores in the seabed.

The invention provides a process for designing a floating offshore platform with minimum motion response. The platform comprises a submersible lower hull including a plurality of hull segments. A stabilizing superstructure extends upwardly from the lower hull. The superstructure includes a plurality of vertical hollow tubular stabilizing columns disposed in angularly spaced-apart relation. The process includes the steps of (a) maximizing the water plane area of the columns so that the natural heave period is just beyond the maximum wave period in the surrounding sea, whereby the maximized water plane tends to maximize the change in buoyancy of the columns' wetted length, and (b) reducing the forces acting on the lower hull until they become substantially equal in amplitude but opposite in direction to the forces resulting from the change in buoyancy in the columns.

BRIEF DESCRIPTION OF THE DRAWINGS

FIG. 11(*b*) shows a mathematical model of FIG. 11(*a*) for heave motion;

FIG. 12(*b*) is an illustration of forces acting on the column and lower hull in the crest of a wave;

DETAILED DESCRIPTION OF A PREFERRED EMBODIMENT AND OF THE PROCESS FOR MAKING SAME

Figure 1:
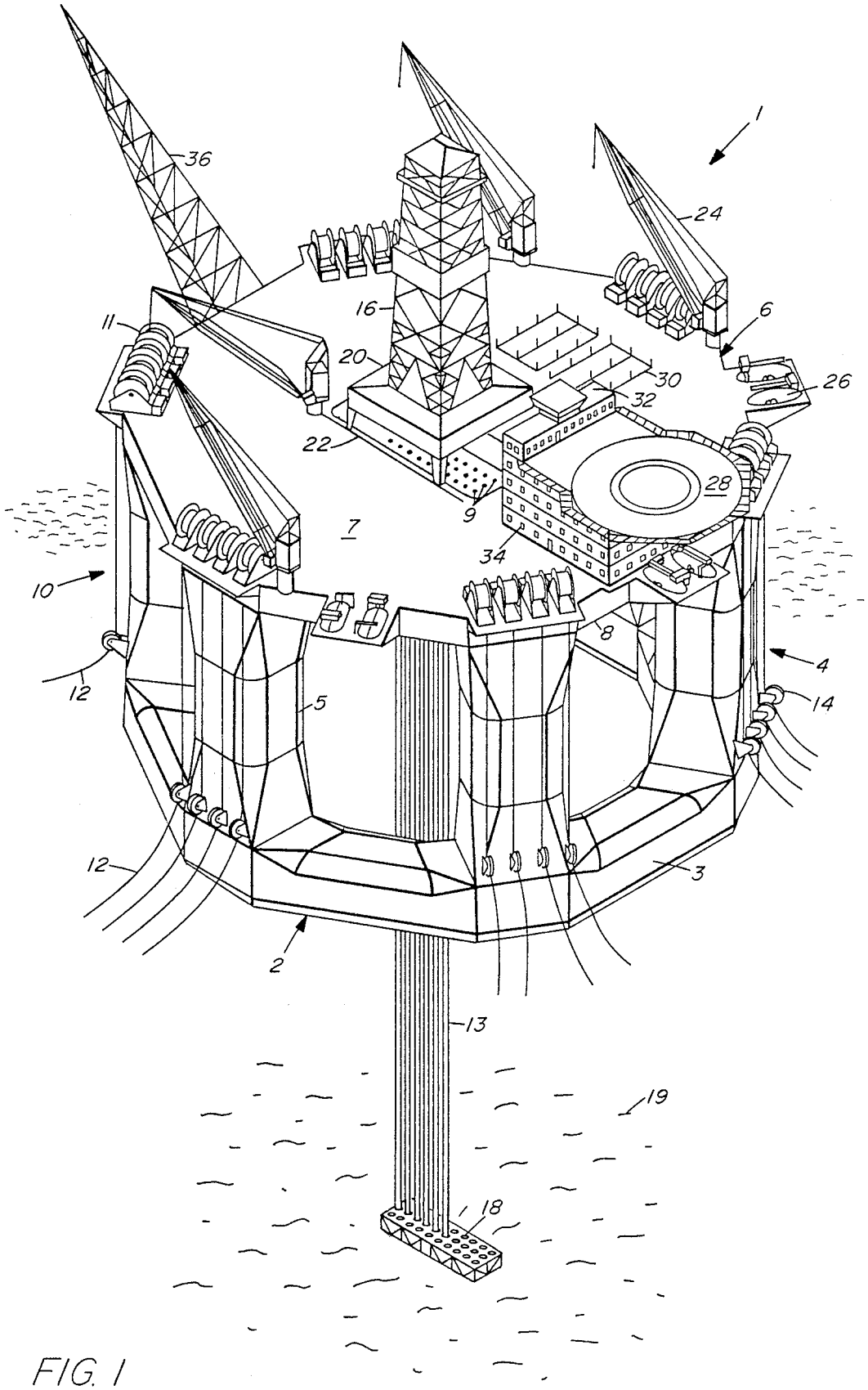
FIG. 1 is an isometric view of the novel platform unit.

Referring to the drawings, in accordance with this invention, a preferred semi-submersible platform unit 1 (FIG. 1) is provided in which the lower hull 2 comprises a plurality of hollow hull segments 3, equally spaced-apart and of equal length. The hull segments 3 support therebetween a superstructure 4 comprising a plurality of large-diameter, hollow, vertical tubular columns 5, preferably six or more in number. Columns 5 support an upper' hull 6 having a main deck 7 and deck 8. Suspended from hull 6 are a plurality of conventional surface-type wellheads 9.

Figure 5:
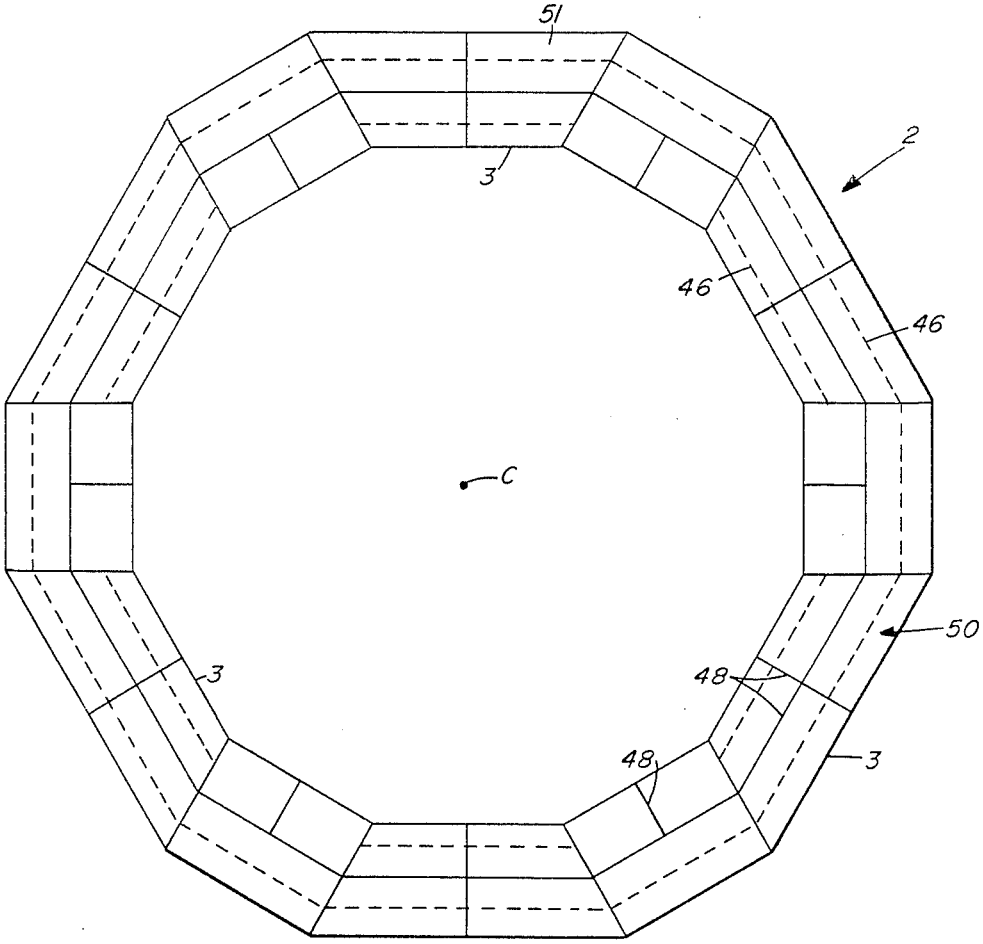
FIG. 5 is a bottom plan view of the lower hull showing tank arrangement.

Columns 5 are arranged in a generally circular configuration adapted to provide uniform stability in all directions, and to afford maximum floating stability under all expected stages and production operating conditions. The angular spacing of columns 5 (FIG. 10) on the circle, while not necessarily equal in all cases, generally provides a preferred symmetrical arrangement about the center C (FIG. 5) of the circle.

Figure 2:
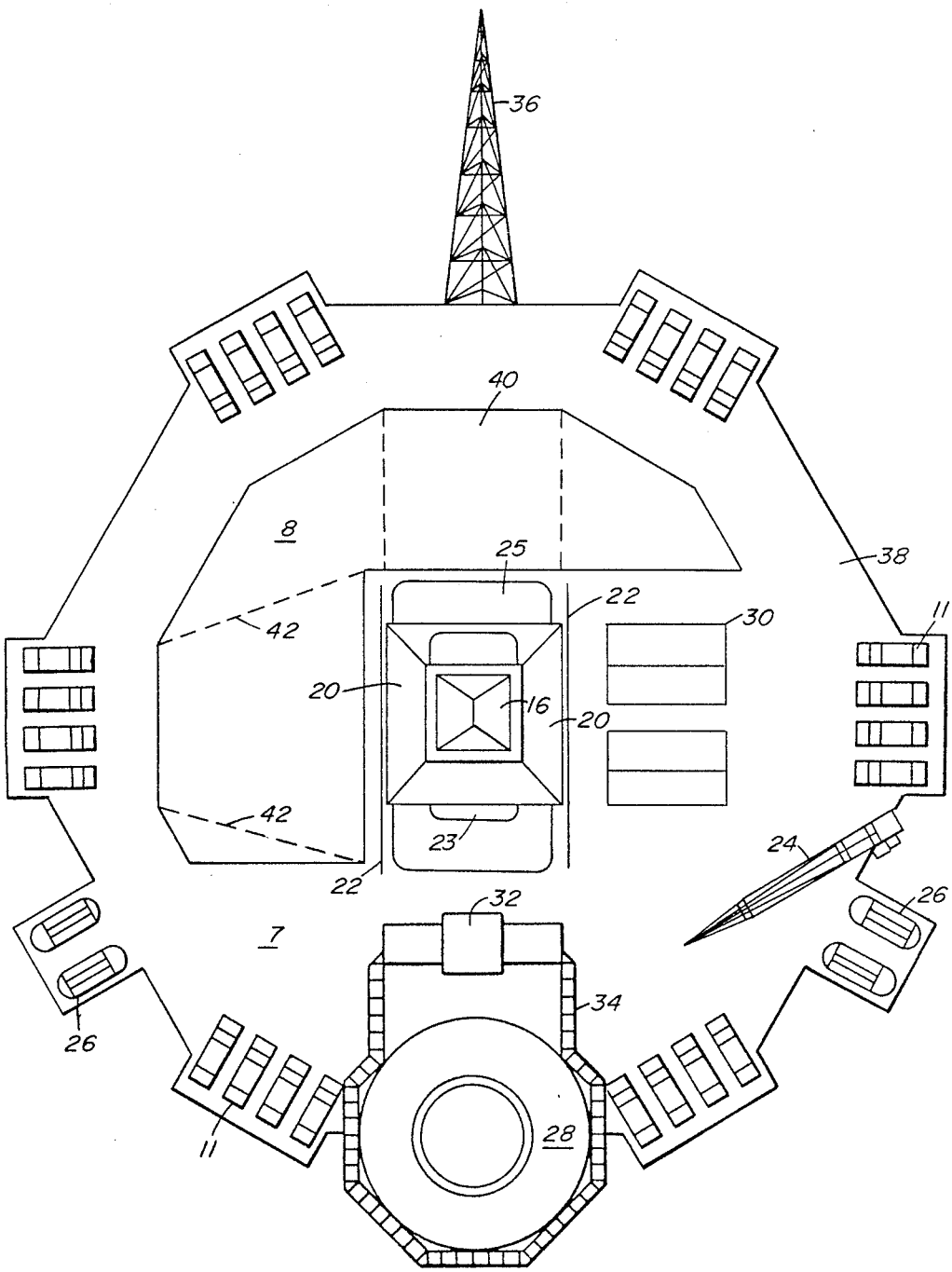
FIG. 2 is a top plan view of the drilling and production equipment arrangement on the main deck.
Figure 3:
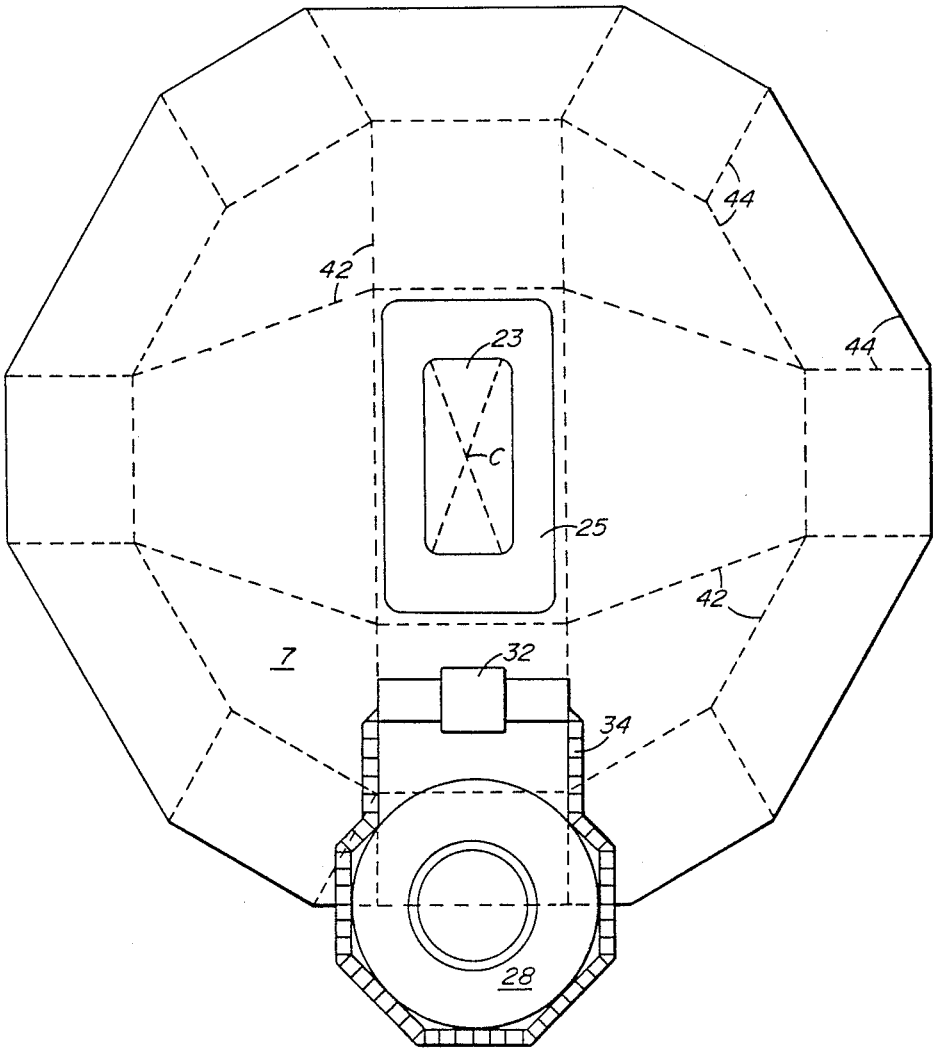
FIG. 3 is top plan view of the main deck.
Figure 4:
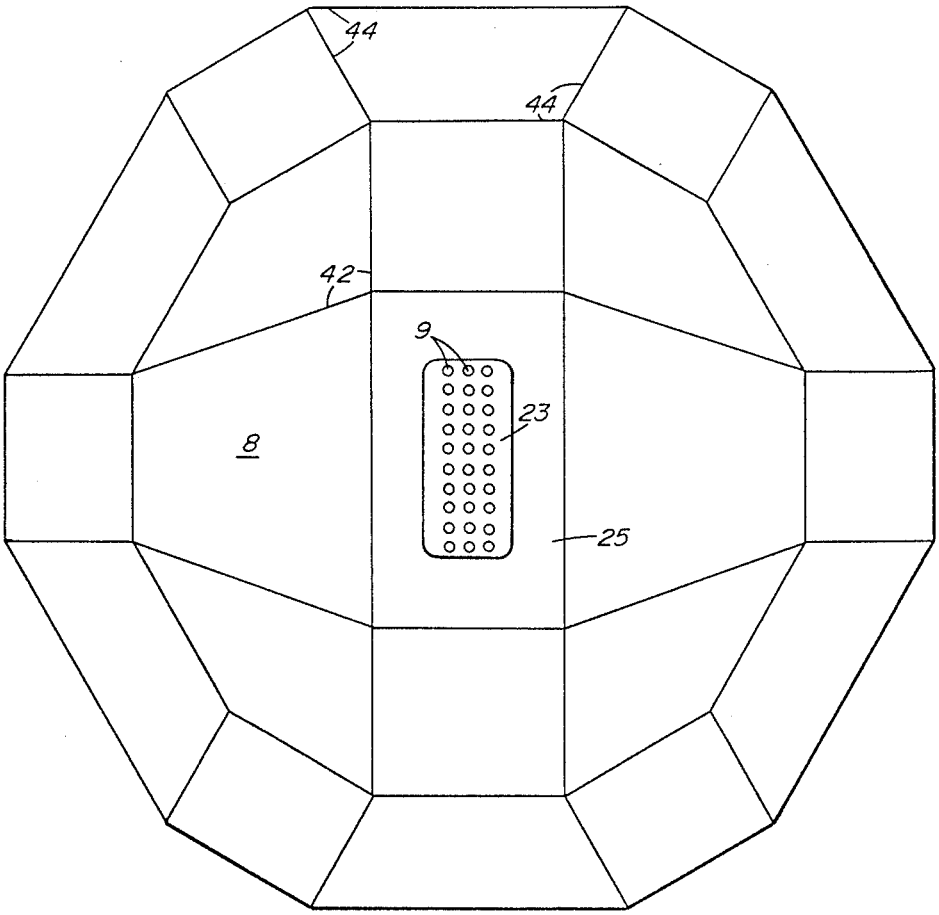
FIG. 4 is a top plan view of the lower deck.

Platform 1 is moored on the production location by a mooring system 10 commonly known as a catenary spread mooring system, which is described in applicant's U.S. Pat. Nos. 3,912,228, 3,929,087, 3,931,782 and 4,336,843, including winches 11, fairleaders 14, mooring lines 12, and anchors, etc., all well known in the art. Mooring lines 12 include chain wire rope and anchors. Individual production risers 13, extending from a template 18 on the seabed 19, bring the oil and gas production to the surface-type wellheads 9 on-lower as shown. Upper hull 6 is provided with the various housings needed to accommodate personnel and drilling production equipment including a drilling derrick 16 (FIG. 2). The derrick 16 is mounted on a drill floor 20 riding on a skid 22 over a cellar deck 25 and a moonpool 23. On main deck 7 are cranes 24, lifeboats 26, a hellideck 28, pipe racks 30, a ballast control room 32, living quarters 34, a flat boom 36, and other instrumentalities useful and necessary for drilling and production. The drilling equipment is within the area designated as 38, and the production equipment is within an area 40.

It will be understood that the members forming platform 1 are divided, by means of suitable trusses 42 (FIGS. 2–8), main bulkheads 44, non-water-tight bulkheads 46 and watertight bulkheads 48, into a plurality of compartments 50, some of which are ballast tanks 51 connected to a suitable pumping system for ballasting and de-ballasting the compartments, all in accordance with known practices, to effect submergence and raising of the platform as required during production and towing operations. Some of such compartments are typically also employed for storage of fresh water, fuel oil, drill water, etc.

The desired low motion response is achieved by designing floating platform 1 so that the resultant vertical wave force on the submerged hull segments 3 is nearly equal and opposite to the buoyant forces on columns 5 which pierce the water surface.

Platform unit 1 is tuned so that the net or resultant vertical wave forces are minimized. This tuning is achieved by varying the floating draft, the shape of submerged hull segments 3, and the column diameter so as to find a vertical force combination which produces a platform unit 1 having least motion response, and being capable of carrying the required gravity load, and of safely resisting wind, wave, current, and anchor forces under severe storm conditions. Tuning floating unit 1 will achieve minimum motions in wave because the buoyant force on columns 5 due to a change in column wetted length is in the opposite direction to the vertical wave forces on the submerged hull segments 3.

At the wave's crest FIG. 12(*b*), the wave surface 52 is normally above the still water surface 54. Consequently, the buoyant force $F_c$ is in the upward direction and its magnitude varies with the column's cross sectional area for a given wave height. On the other hand, the vertical component of the wave force $F_h$ on the submerged lower hull 2 is in the downward direction at the wave crest, and its magnitude for a given wave height varies with the volume of lower hull 2, its shape, and its draft, i.e., its distance d (FIG. 12(*a*)) below wave surface 54. The vertical wave force $F_h$ on submerged lower hull 2 is proportional to its volume and is inversely proportional to the draft. The volume of lower hull 2 is also dictated by the load carrying requirements at the transit draft.

Figure 9:
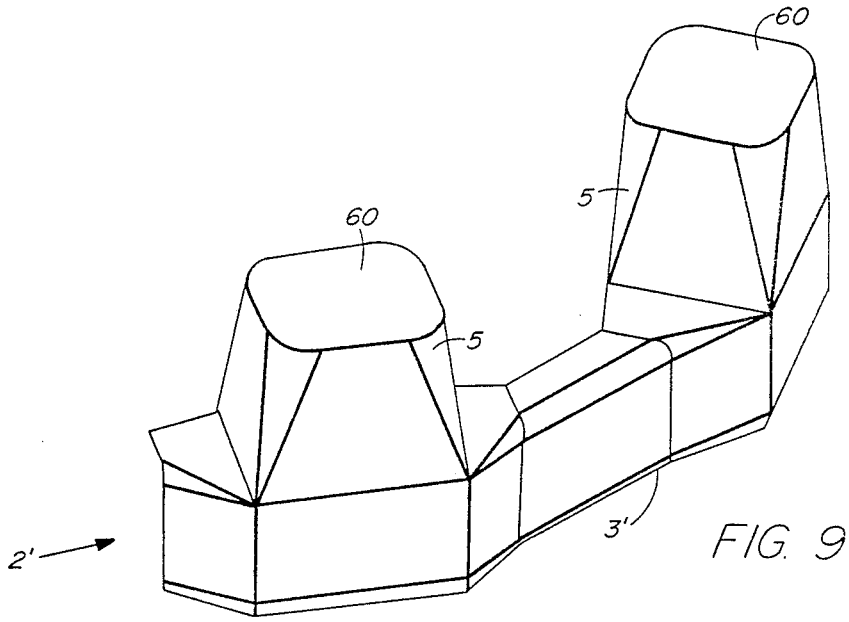
FIG. 9 is a partial perspective view of a modified lower hull segment.
Figure 10:
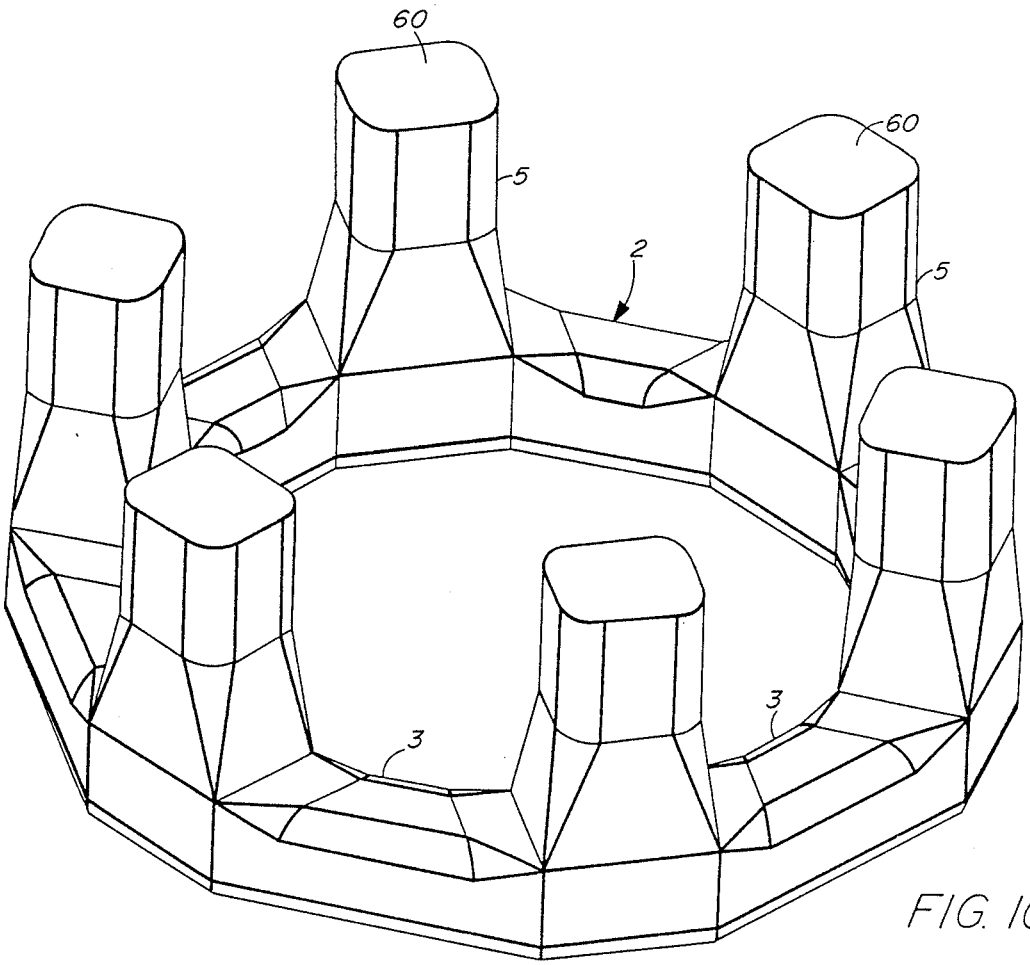
FIG. 10 shows the column total water plane area.

The vertical column force $F_c$ is proportional to the column's cross sectional area 60 (FIGS. 9–10). At the wave trough (FIG. 12*a*), the forces $F_c$ on columns 5 and the forces $F_h$ on submerged lower hull 2 are in opposite directions to the respective forces associated with the wave's crest FIG. 12*b*.

The net or resultant force difference between the column force $F_c$ and the submerged lower hull force $F_h$ causes the vertical motion or heave, and the angular motions roll and pitch to take place about the principal horizontal axes.

The amplitude of the resultant of these three motions is most influential for platform 1 to continue operations under given environmental conditions. Therefore, it is necessary to minimize the resultant vertical forces in order to reduce their consequential motions.

In the normal operating range of wave periods, the vertical wave force $F_h$ on submerged lower hull 2 is greater than the buoyant force change on columns 5. Thus, the predominant wave forces on submerged lower hull 2 normally dictate the motions of interest.

To counteract the, dominant forces on submerged lower hull 2, the columns' total sectional area 60 (FIG. 10) may be increased to an optimum value for which the natural period of heave approaches the maximum period of the waves expected in the geographic area of operation.

Since the total sectional column area 60 and the volume of lower hull 2 are determined from the above considerations, it is now possible to vary the draft and the shape of lower hull 2 to minimize the net resultant of the combined vertical forces and thereby reduce the resultant motions of interest.

By virtue of the greatly improved response and the resulting very small vertical motions, it is now feasible to suspend conventional surface-type and relatively inexpensive wellheads 9 from upper hull 6 and connect them with piping or risers 13 to the wellbores in seabed 19, and to accommodate the small relative movements of platform 1 by constant tension on the risers provided by jack or other tensioning devices (not shown) and by flexible piping (not shown) between the wellheads 9 and the onboard production equipment.

The total water plane area 60 provided by columns 5 (FIG. 10) is one of the principal parameters in determining the natural frequency and heave response of platform unit 1. Columns 5 must be sized such that in the anticipated sea operation, the excitation periods created by the environment will be less than the natural period of resonance $T_n$ of platform 1 FIG. 13.

Figure 14:
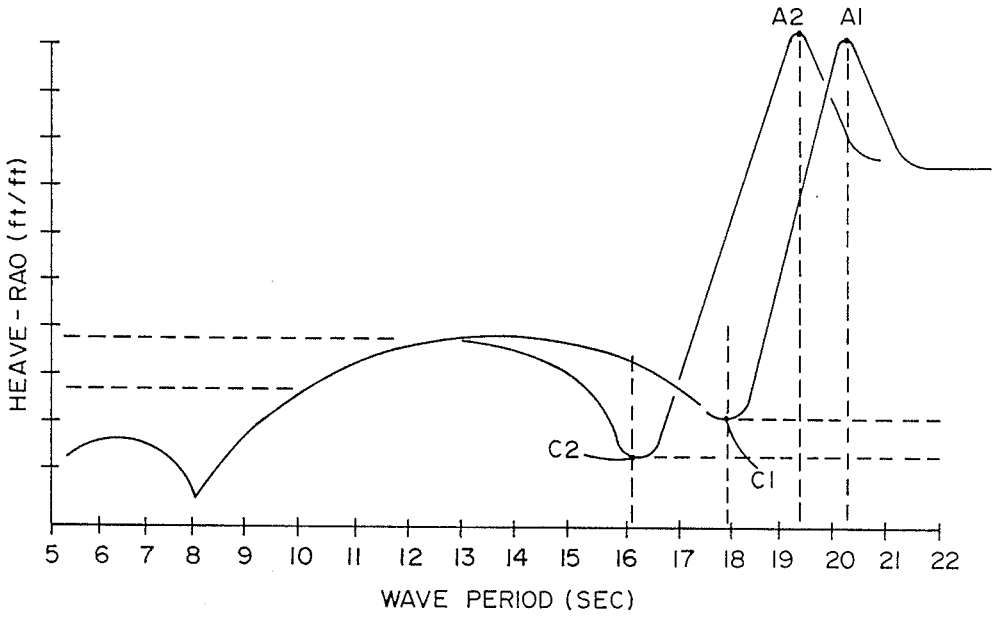
FIG. 14 is a modified graph similar to FIG. 13.

Increasing the cross sectional areas 60 of columns 5 progressively reduces the overall response and also reduces the natural period of resonance from A1 to A2 (FIG. 14). However, one of the design constraints is that by increasing the water plane area 60 of columns 5, point C1 must not shift to a wave period C2 less than that which corresponds approximately to a 100 year storm wave condition, which is for example, a 16 second period for storm waves in the Gulf of Mexico. Following this design constraint, platform 1 is protected from the region of rapidly increasing response, when approaching the resonance curve from points C1 to A1 or C2 to A2 (FIG. 14).

Figure 15:
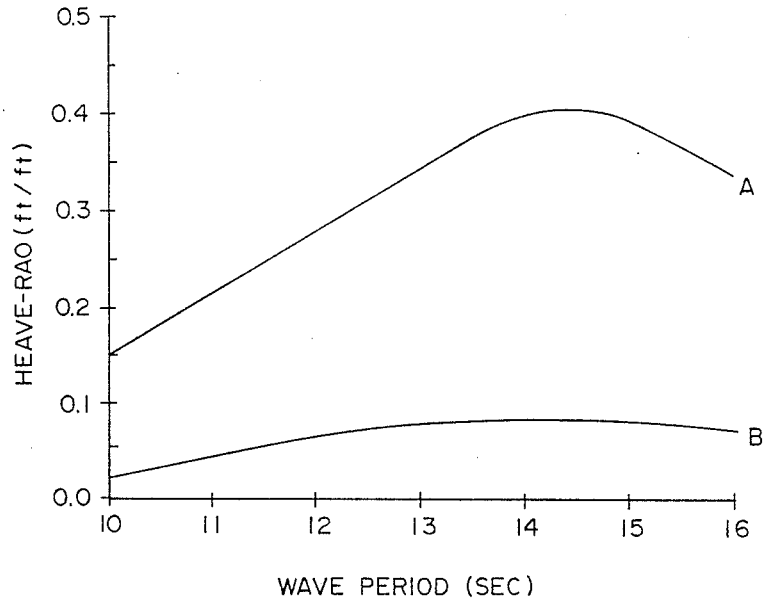
FIG. 15 shows heave response curves for comparison.

Deepening the draft or increasing the submerged depth of segments 3 will further reduce the response of platform 1. FIG. 15 compares the heave response of a typical semi-submersible (Curve A) with the improved response of platform 1 (Curve B). The heave response or RAO (Y-axis) is the ratio of the heave of the vessel divided by the amplitude of the wave in the seaway shown as a function of wave period. The responses are shown only for the range of wave period of concern for production operations.

Figure 16:
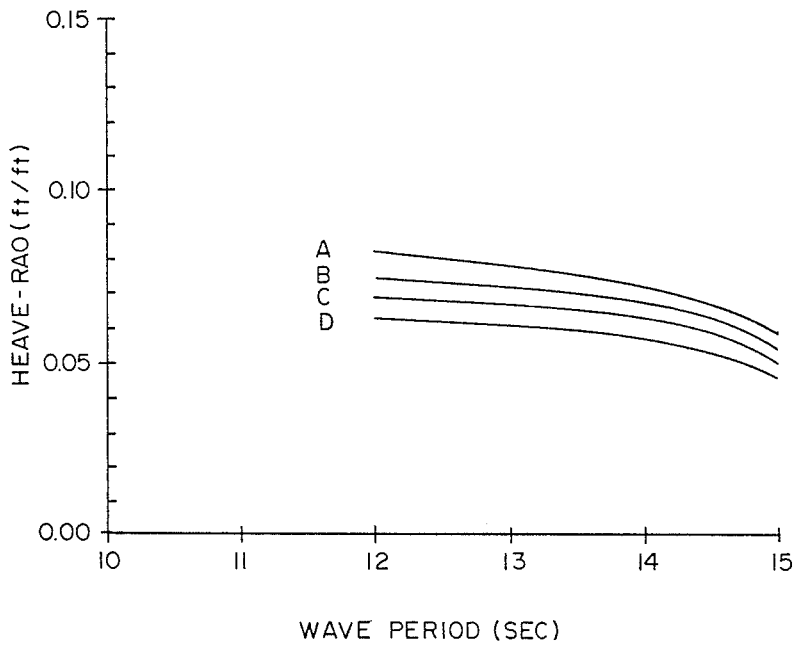
FIG. 16 shows heave response curves of the novel platform for different operating drafts.

FIG. 16 shows the generally beneficial effects on heave response achieved by increasing the draft of platform unit 1. FIG. 16 shows the analytically predicted values of heave response (RAO) plotted as a function of wave period for the geometry of platform 1. Curve A is the heave response of unit 1 operating at submerged drafts, respectively of 140 ft., curve B at 150 ft., curve C at 160 ft., and curve D at 170 ft.

By combining the above two steps of shifting the curves in FIG. 14 and of adjusting the draft in FIG. 16, a minimum response will be achieved within the given design constraints.

The maximum heave or displacement in the vertical direction due to a 50 ft wave for a vessel having the motion characteristics of curve A (RAO=0.4), as shown in FIG. 15, would be $0.4\times 50=20$ ft. for a platform 1 as described herein, the heave is significantly reduced and would be less than 5 ft. (RAO<0.1).

THEORETICAL CONSIDERATIONS REGARDING PLATFORM'S RESPONSE

Figure 11A:
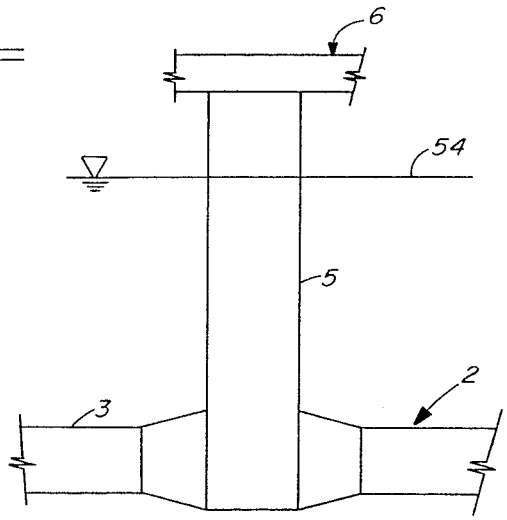
FIG. 11(*a*) shows a single column with two adjacent lower hull elements.
Figure 11B:
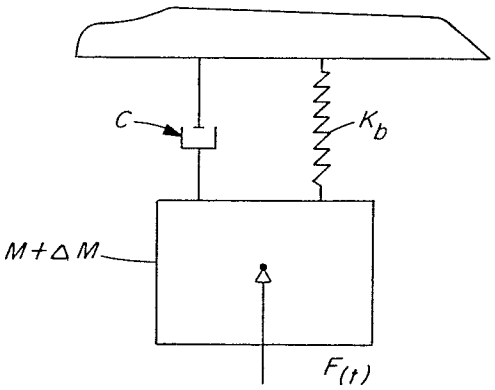
Figure 8:
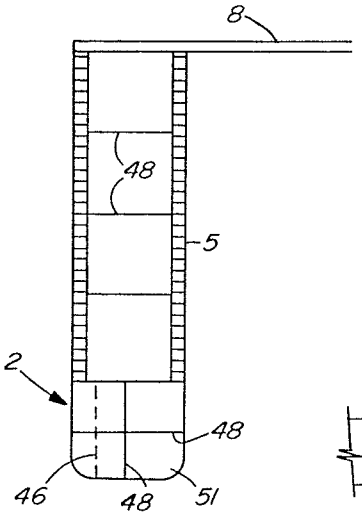
FIG. 8 is a longitudinal inboard view taken along line 8—8 of FIG. 6.
Figure 6:
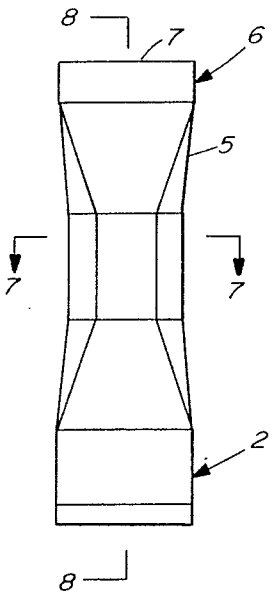
FIG. 6 is an outboard elevational view of a single column and its upper and lower hull parts.
Figure 7:
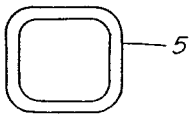
FIG. 7 is a transverse sectional view taken along line 7—7 of FIG. 6.

FIG. 11(*a*) dipicts a column-lower hull segment of platform 1. From FIG. 11(*b*) an equation of uncoupled heave motion may be derived as:

$$(M+\Delta M)\ddot{y}+c\dot{y}+K_b y=F(t) \tag{1}$$

Where $M$=mass of the segment
$M$=added mass of the segment
$K_b$=buoyancy spring constant
$\ddot{y}$=heave acceleration
$y=y_o\cos(wt+a)$, heave motion
$\dot{y}$=heave velocity
$y_o$=heave amplitude
$c$=damping coefficient
$w=2\pi/T$
$T$=wave period
$a$=phase angle
$t$=time, seconds
$F(t)$=excitation force for heave The buoyancy spring constant $K_b$ is a function of water plane area 60 provided by surface piercing of column 5.

$$K_b=\gamma A_c \tag{2}$$

where $\alpha$ is the gravity of salt water and $A_c$ is water plane area 60 of the column.

The heave excitation force F(t) consists of forces acting on column 5 and lower hull segment 3 due to a wave passing by the segment. This force may be described as:

$$F(t)=F_c+F_h \tag{3}$$

where $F_c$ is a force on column 5 and $F_h$ is a force on segment 3.

Figure 12A:
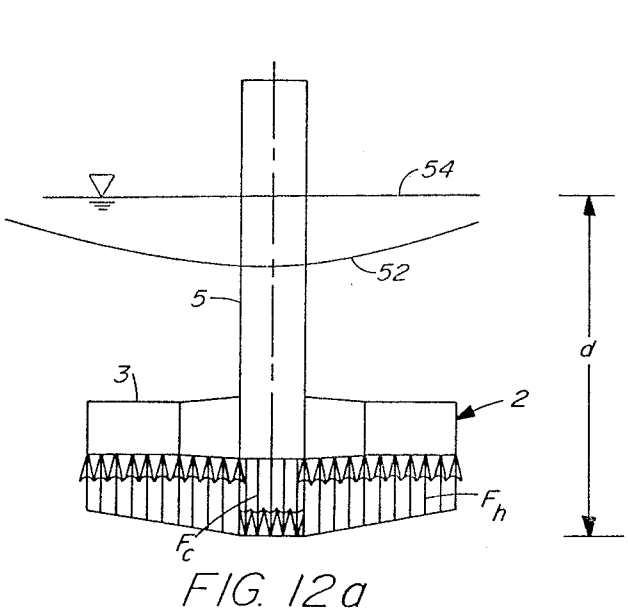
FIG. 12(*a*) is an illustration of forces acting on the column and the lower hull in the through of a wave.
Figure 12B:
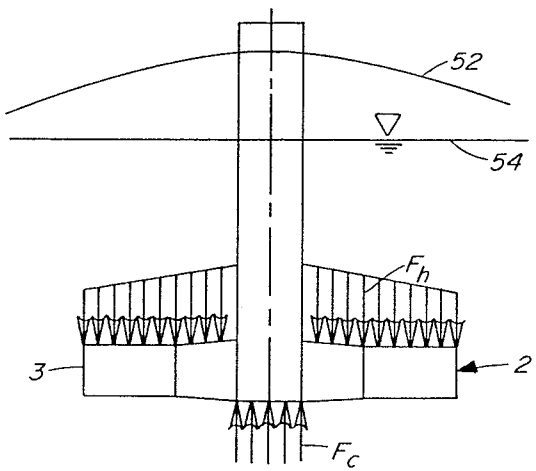

FIG. 12 shows a simplified illustration of equation (3) under the crest (FIG. 12*b*) and trough (FIG. 12*a*) positions of a wave profile 52.

The column force $F_c$ is a buoyant force due to the change in elevation of water surface on column 5 as the wave passes by platform 1. Thus, $$F_c=\gamma A_c A_w e^{-kd}\cos(kx-wt) \tag{4}$$

where $d$=draft of platform 1
$A_w$=wave amplitude
$k=4\pi^2/gT^2=1.225/T^2$
$g$=gravitational acceleration
$x$=position of wave crest with respect to the vertical center line of unit 1.

Since the cosine term in equation (4) becomes 1 under crest and −1 under trough, equations (4a) and (4b) can be written for column force $F_c$ under the crest and trough, respectively:

$$F_c=\gamma A_c A_w e^{-kd} \tag{4a}$$

$$F_c=\gamma A_c A_w e^{-kd} \tag{4b}$$

Equations (4a) and (4b) reveal that the column vertical force $F_c$ due to waves increases linearly as the water plane area increases, and decreases hyperpolically as the draft increases.

The lower hull force $F_h$ consists of drag force and inertia force due to water particle velocity and acceleration. This relationship may be described as $$\begin{aligned} F &= 0.5\, C_d\, \rho w A w e^{-kd}\sin(kx-wt)\, D_h L_h \\ &= (M_h+\Delta M_h) w^2 A_w e^{-kd}\cos(kx-wt)\, L_h \end{aligned} \tag{5}$$

Under the wave crest and trough, equation (5) becomes:

$$F_h=(M_h+\Delta M_h)w^2 A_w e^{-kd} \tag{5a}$$

$$F_h=(M_h+\Delta M_h)w^2 A_w e^{-kd} \tag{5b}$$

where $C_d$=drag coefficient
$D_h$=equivalent hull diameter
$M_h$=Mass of hull element
$\Delta M_h$=added mass of hull element
$L_h$=length of hull element From equations (5a) and (5b), it can be seen that the lower hull hydrodynamic force $F_h$ due to water particle acceleration is proportional to the sum of the mass of lower hull 2 and its added mass. The heave excitation force F(t) for the mathematical model is shown in FIG. 11(*b*) and may be derived by combining equations (4a) and (5a) under crest, and equations (4b) and (5b) under trough.

$$F(t)=e^{-kd}\{\gamma A_c A_w-(M_h+\Delta M_h)w^2 A_w\} \quad (6a)$$

$$F(t)=e^{-kd}\{-\gamma A_c A_w+\Delta M_h)w^2 A_w\} \quad (6b)$$

Figure 13:
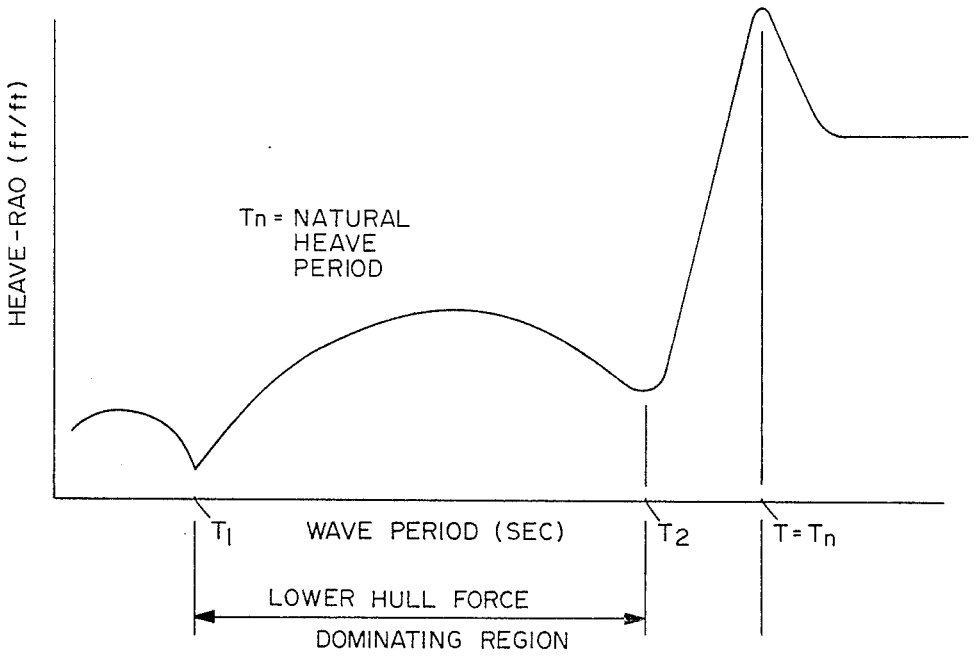
FIG. 13 is a typical graph illustrating the heave RAO curve of semi-submersible vessels.

Equations (6a) and (6b) show that in the region of lower hull force dominating area of heave motion, which is depicted in FIG. 13, the excitation force may be minimized by maximizing water plane area and 60 of column 5 optimizing the shape of lower hull 2 such that the effect of added mass is reduced. Also, equations (6a) and (6b) reveal that the excitation force decreases hyperbolically as draft increases.

Water plane area, lower hull shape section and displacement, and draft are interrelated. Hence, the excitation force may be minimized by optimizing their respective values.

The foregoing equations describe a heave excitation force on the model segment (FIG. 11*a*) due to a wave passage. For the whole platform unit 1, the excitation force on each segment under a given wave profile must be added.

Let $M_t$=total mass of the platform unit 1

$M_t$=total added mass $C_t$=total damping coefficient $K_{bt}$=total buoyancy spring constant $F_t(t)$=total heave excitation force on the platform unit then the equation of uncoupled heave motion may be expressed as $$(M_t+\Delta M_t)\ddot{y}+C_t y+K_{bt}\dot{y}=F_t(t) \quad (7)$$

where $y=y_o \cos(wt+a)$

A solution of the differential equation shown above yields heave amplitude:

$$y_o=\frac{F_t(t)}{K_{bt}}\cdot\frac{1}{\sqrt{(1-r^2)^2+(2fr)^2}} \quad (8)$$

where $r=T_n/T$ $f=C_t/C_c$, damping ratio $$T_n=2_r\sqrt{(M_t+\Delta M_t)/K_{bt}},$$

natural heave period $C_c=2(M_t+\Delta M_t)(2\pi/T_n)$, critical damping coefficient Equation (8) shows that in the region of hull force dominating area (see FIG. 13), the increase of water plane area decreases heave amplitude. Since the increase of water plane area decreases the natural heave period, one must be careful in maximizing the water plane area such that the heave natural period falls beyond the range of substantial wave energy expected in extreme storms.

COMPARISON BETWEEN PLATFORM 1 AND A TENSION LEG PLATFORM

A known tension leg platform (TLP) uses tubular members (not shown) called tethers or tendons which are fixedly anchored to the sea bed. Conventional surface-type well heads are mounted onboard the TLP. The TLP's motion is restrained by the tethers and its heave response is governed partly by the elasticity of the tether lines. The TLP tether lines are subject to cyclic loading and must be replaced periodically to avoid fatigue failure. The anchored TLP unit cannot be easily relocated to a new position.

On the other hand, the novel platform 1 is anchored to the seabed utilizing a conventional chain wire-rope mooring system 10 which restrains the platform's lateral displacements.

The goal is for the heave response for platform 1 to be less than 10% of wave height, hence making it feasible to isolate the small motions of platform 1 from the wellheads 9 by using known motion compensating systems, as above described, with assurance that wellhead system 9 will survive any anticipated storm.

Platform unit 1 can be constructed using conventional shipbuilding practices in relatively shallow water ports utilizing existing shipyard facilities, whereas the known TLP requires deep water facilities for construction and erection.

The cost of constructing, installing and maintaining the TLP is considerably greater than the cost associated with constructing, installing and maintaining the novel platform unit 1 of this invention.

It will be apparent that variations are possible without departing from the scope of the invention. For example, modified hull segment 3 'of lower hull' can have non-uniform cross sections (FIG. 9) to reduce drag and the effects of added mass. The geometry of lower hull 2, especially its symmetry and its depth below sea surface, are selected so that platform unit 1 has a minimum response to the excitation by a seaway. In addition, the total column water plane area is maximized to effect partial cancellation of hull forces within the have period range of interest which in turn results in a reduced net force on platform 1.

What is claimed is:

1. A column-stabilized, semi-submersible platform for conducting in a seaway drilling or production operations, or both, in and/or from a well site in the seabed submerged in a deep body of water, comprising:

(a) a submersible lower hull including a plurality of hollow, tubular, spaced-apart hull segments;

(b) a superstructure extending from said lower hull, said superstructure including a plurality of substantially vertical, hollow, tubular stabilizing columns and an upper hull supported by said columns;

(c) at least one wellhead tree suspended from a deck on said platform for controlling said production;

(d) a production riser coupling said wellhead tree to at least one well on said site; and (e) a plurality of catenary mooring lines for mooring said platform to said seabed during said drilling or production or both.

2. A platform according to claim 1, wherein at least one of said catenary mooring lines includes chain and wire rope, and said mooring lines are connected between said platform and said seabed at distances horizontally spaced from said well, thereby restraining said platform from substantial lateral displacements; and said platform is designed to undergo limited vertical and angular movements in said seaway without hindering said hydrocarbon production through said wellhead tree and said riser.

3. A platform according to claim 2, wherein said movements include surge, sway, yaw, heave, roll and pitch in response to high waves and severe storms in said seaway.

4. A platform according to claim 3, wherein said platform has at least one plane of symmetry relative to a vertical center axis.

5. A platform according to claim 4, wherein said columns are angularly spaced-apart relative to said center axis.

6. A platform according to claim 3, wherein the natural heave period of said platform is greater than the maximum period of waves having substantial energy in said seaway.

7. A platform according to claim 6, wherein said columns are designed to have a water plane area depending on said natural heave period of said platform.

8. A platform according to claim 3, wherein the natural periods of said pitch, roll, heave, surge, sway, and yaw motions are greater than the corresponding periods of waves having substantial energy in said seaway.

9. A platform according to claim 6, wherein said columns have a water plane area, and said lower hull and said columns having respective shapes and masses depending on said natural heave period of said platform.

10. A platform according to claim 9, wherein the maximum heave of said platform is less than 10% of the maximum wave crest in said seaway.

11. A platform according to claim 2, wherein said upper hull is supported substantially entirely by the upper ends of said columns and by said lower hull; and said platform has a natural heave period which is greater than the maximum expected period of waves having substantial energy in said seaway.

12. In a column-stabilized, semi-submersible platform having substantially vertical and substantially horizontal buoyant members adapted to be ballasted and deballasted, and provided with drilling and production equipments for carrying out simultaneous or consecutive drilling and production operations in a seaway over a selected well site in the seabed, comprising:

means for mooring said platform over said site with catenary mooring lines;

means for suspending a surface tree from a deck on said platform; and means for conducting consecutive or simultaneous drilling and production operations from said platform at said site, while said platform is moored to said seabed with said mooring lines during said drilling or production or both.

13. A column-stabilized, semi-submersible platform adapted to float in a seaway over at least one well in a seabed site, said platform comprising:

deck means;

buoyant members adapted to support said deck means, and said members including substantially horizontal buoyant members connected to substantially vertical buoyant members;

catenary spread mooring lines for mooring said platform to said seabed;

means for suspending at least one wellhead tree from said deck means;

production equipments on said deck means adapted to carry out production operations from said well, said production operations being conducted through said wellhead tree while said platform is moored to said seabed with said mooring lines; and said vertical and horizontal buoyant members being designed to have a mass and a geometry such that (1) the natural periods of pitch, roll and heave of said platform are greater than the corresponding periods of the waves having substantial energy in said seaway, and that (2) in response to high waves in said seaway, said buoyant members have displacement relationships tending to produce vertical force cancellations and angular displacement so as to enable said production in said seaway through said wellhead tree.

14. A platform according to claim 13, and a production riser coupling said wellhead tree to said well;

said catenary mooring lines are connected between said platform and said seabed at distances horizontally spaced from said well, thereby restraining said platform from substantial lateral displacements; and said platform being designed to undergo limited vertical and angular movements in said seaway to enable said hydrocarbon production through said wellhead tree and said riser.

15. A platform according to claim 14, wherein said movements include surge, sway, yaw, heave, roll and pitch in response to high waves and severe storms in said seaway.

16. A platform according to claim 14, wherein said deck means is supported substantially entirely by the upper ends of said vertical buoyant members and by said horizontal buoyant members; and said platform has a natural heave period which is greater than the maximum expected period of waves having substantial energy in said seaway.

17. The platform according to claim 14, and means for conducting consecutive or simultaneous drilling and production operations from said platform at said site, while said platform is moored to said seabed with said mooring lines.

18. A platform according to claim 15, wherein said platform has at least one plane of symmetry relative to a vertical center axis.

19. A platform according to claim 15, wherein the natural heave period of said platform is greater than the maximum period of waves having substantial energy in said seaway.

20. A platform according to claim 15, wherein the natural periods of said pitch, roll, heave, surge, sway, and yaw motions are greater than the corresponding periods of waves having substantial energy in said seaway.

21. A platform according to claim 19, wherein said columns have a water plane area in dependence upon said natural heave period of said platform.

22. A platform according to claim 19, wherein said vertical buoyant members have a water plane area, and said vertical buoyant members and said horizontal buoyant members having respective shapes and masses in dependence upon said natural heave period of said platform.

23. A platform according to claim 22, wherein said natural heave period is greater than the maximum period of waves having substantial energy in said seaway, and the maximum heave of said platform is less than 10% of the maximum wave crest in said seaway.

24. A platform according to claim 18, wherein said vertical buoyant members are angularly spaced-apart relative to said center axis.

25. A platform according to claim 16, wherein said natural heave period is greater than the maximum period of waves having substantial energy in said seaway, and the maximum heave of said platform is less than 10% of the maximum wave crest in said seaway.

26. A column-stabilized, semi-submersible platform designed for conducting consecutive or simultaneous drilling and production operations, comprising:

substantially vertical and substantially horizontal buoyant members adapted to be ballasted and deballasted;

production equipments for conducting production operations from a well in the seabed within a selected ocean well site;

means for suspending at least one surface wellhead tree from a deck on said platform; and catenary mooring means for mooring said platform to said seabed while said consecutive drilling or production operations are being conducted from said site under the control of said surface wellhead tree.

27. The process for designing a semi-submersible production platform for conducting consecutive or simultaneous drilling and production operations in a particular seaway, said platform comprising a submersible lower hull having a plurality of hollow, tubular, spaced-apart hull segments; a stabilizing superstructure extending from said lower hull; said superstructure comprising a plurality of partially submersed, hollow, tubular, stabilizing columns disposed in angularly spaced-apart relation, said process including the steps of:

sizing the water plane area of said columns so that (a) the natural heave period of said platform is greater than the periods of waves having substantial energy in said seaway; and (b) the forces acting on said lower hull become substantially equal in amplitude but opposite in direction to the forces resulting from changes in the wetted lengths of said partially submersed columns in said seaway.

28. The process according to claim 27, and (c) designing said lower hull and said columns to have a mass and draft so that said platform maintains a heave response which is compatible with said production operations in the worst expected storm within said seaway.

29. In a method of conducting consecutive or simultaneous drilling and production operations in deep waters from a column-stabilized, semi-submersible platform having deck means and substantially vertical and substantially horizontal buoyant members adapted to be ballasted and deballasted, and provided with drilling and production equipments on said deck means for carrying out consecutive or simultaneous drilling and production operations in and from at least one well in a seabed site, comprising the steps of:

(a) towing said platform to said site;

(b) positioning said platform at a selected draft;

(c) mooring said platform to said seabed with catenary mooring lines;

(d) suspending at least one wellhead tree from a deck on said platform; and (e) conducting consecutive or simultaneous drilling and production operations from said platform in and/or from said site, while said platform is moored to said seabed with said mooring lines during said drilling or production or both.

* * * * *